US006752747B2

(12) United States Patent
Yu

(10) Patent No.: US 6,752,747 B2
(45) Date of Patent: Jun. 22, 2004

(54) MULTI-DIRECTIONAL SWIVEL BODY BUILDER

(75) Inventor: Hui-Nan Yu, Taoyuan (TW)

(73) Assignee: Ya-Chu Hsiao, Changhua Hsien (TW)

( * ) Notice: Subject to any disclaimer, the term of this patent is extended or adjusted under 35 U.S.C. 154(b) by 371 days.

(21) Appl. No.: 10/046,975

(22) Filed: Jan. 17, 2002

(65) Prior Publication Data

US 2003/0134726 A1 Jul. 17, 2003

(51) Int. Cl.[7] ..... A63B 21/00; A63B 21/045
(52) U.S. Cl. ..... 482/110; 482/126; 482/127
(58) Field of Search ..... 482/110, 126, 482/127, 44, 140

(56) References Cited

U.S. PATENT DOCUMENTS 2,714,008 A * 7/1955 Urban ..... 482/126
4,852,873 A * 8/1989 O'Donnell et al. ..... 482/126
5,569,137 A * 10/1996 Uen ..... 482/126
5,695,436 A * 12/1997 Huang ..... 482/121
5,752,901 A * 5/1998 Lee ..... 482/130
5,868,651 A * 2/1999 Washington ..... 482/91
5,891,003 A * 4/1999 Deac et al. ..... 482/106
5,897,471 A * 4/1999 Multanen et al. ..... 482/44
5,904,640 A * 5/1999 Shahinian ..... 482/110
6,022,302 A * 2/2000 McBride ..... 482/121
6,056,677 A * 5/2000 Chin ..... 482/127
6,090,023 A * 7/2000 Liu ..... 482/140
6,126,581 A * 10/2000 Hartsel ..... 482/140
6,220,995 B1 * 4/2001 Chen ..... 482/140
6,436,017 B1 * 8/2002 Chen ..... 482/121

FOREIGN PATENT DOCUMENTS

FR 2591496 A1 * 6/1987 ..... A63B/21/045

* cited by examiner

*Primary Examiner*—Nicholas D. Lucchesi
*Assistant Examiner*—Victor Hwang
(74) *Attorney, Agent, or Firm*—Troxell Law Office PLLC

(57) ABSTRACT

A multi-directional swivel body builder constitutes a bent shank, two sections of joint tube having a ring groove and a lock hole at its far end. The joint tube houses a retaining spring having a turnover leaf and a lock post fitted into the lock hole of the joint tube. The joint tube is inserted into the sleeve tube of the handle. The sleeve tube provides a plurality of adjusting holes. When the joint tube slides in place in the sleeve tube, the catch lug on the inner wall of the sleeve tube will enter the ring groove of the joint tube and press the retaining spring so to allow the handle to move freely along the ring groove for proper angular adjustment. The far end of the handle links with an end wheel. When waving the end wheels with two hands, the bent shank will rotate in cycle.

1 Claim, 10 Drawing Sheets

MULTI-DIRECTIONAL SWIVEL BODY BUILDER

FIELD OF THE INVENTION

This invention relates to a novel multi-directional body builder, in particular with better bending and diverse changes in angle, which is convenient for the player to play with one hand or two hands.

BACKGROUND OF THE INVENTION

Most of the hand grips are installed with spring in the handle, and the player holds the handle and presses the spring with power in an effort to train the hand muscle. However, such hand grip designed with single spring offers lesser bending angle and more than frequently causes personnel injury. Because it is usually not an ergonomically design, it is hard to fit the height of individual body.

Since the hand grips have failed to give a satisfaction to most players, the inventor has devoted for years to seeking an improvement and come up with a multi-directional swivel body builder.

SUMMARY OF THE INVENTION

The main object of the invention is to provide a body builder with two handles adjustable at any angle to optimize the player's requirements and whole body exercise. The bent shank links with the coil springs at each end, easily to be formed into a perfect full round curve, applicable any part of body without invoking injury.

Another object of the invention is to provide an end wheel, a spacer and a lock shaft at each end of handle and keep a safety gap between the end wheel and the handle. When holding the end wheel and swaying it, the bent shank will begin to rotate. For the eccentric design, the bent shank continues self-rotation due to the centrifugal and inertia force.

The technique, method and performance of the invention are explained in great detail with the aid of embodiments as illustrated in the attached drawings.

DETAILED DESCRIPTION OF THE INVENTION

Figure 1:
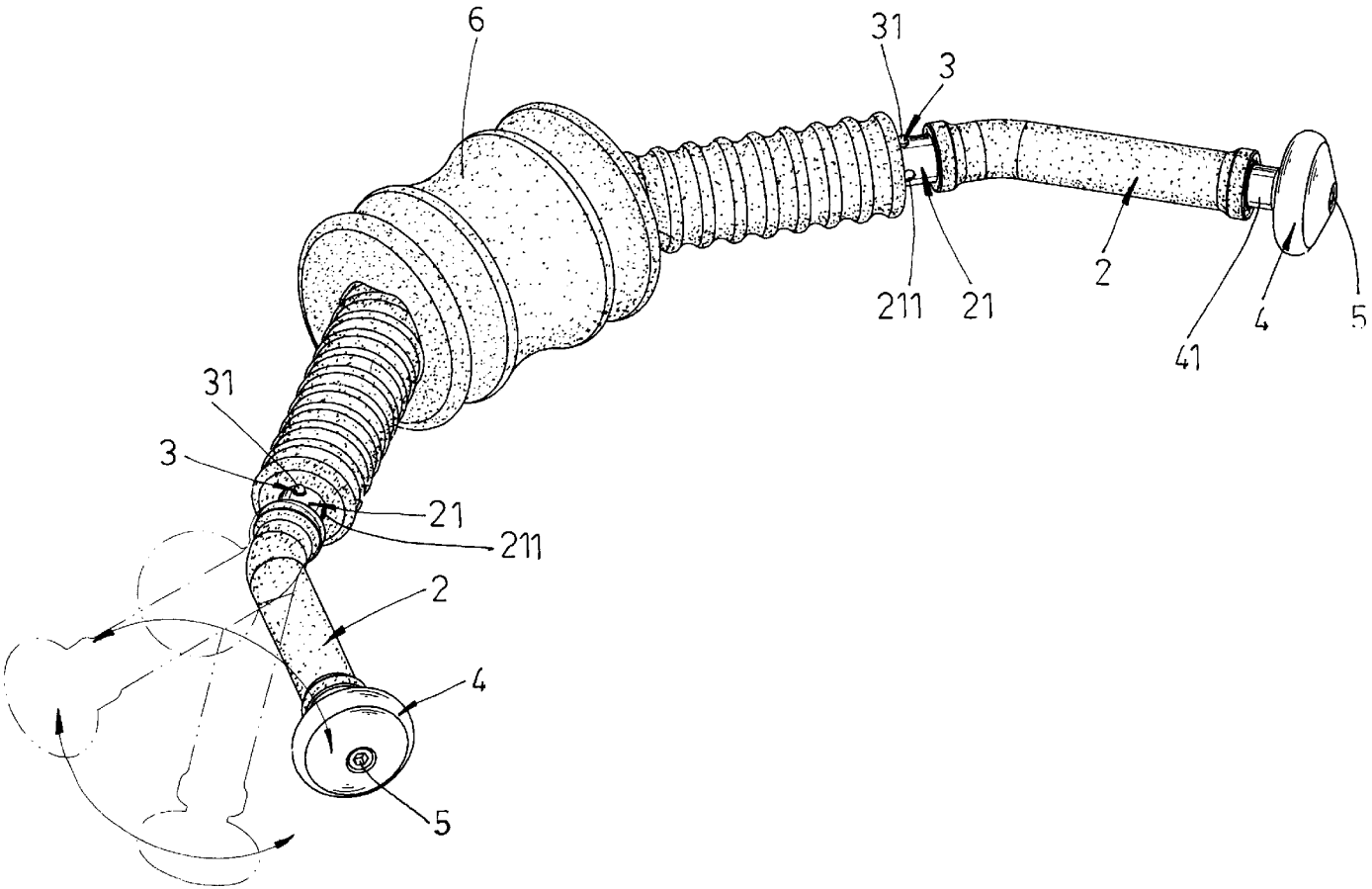
FIG. 1 is a stereo outlook of a body builder of the invention.
Figure 2:
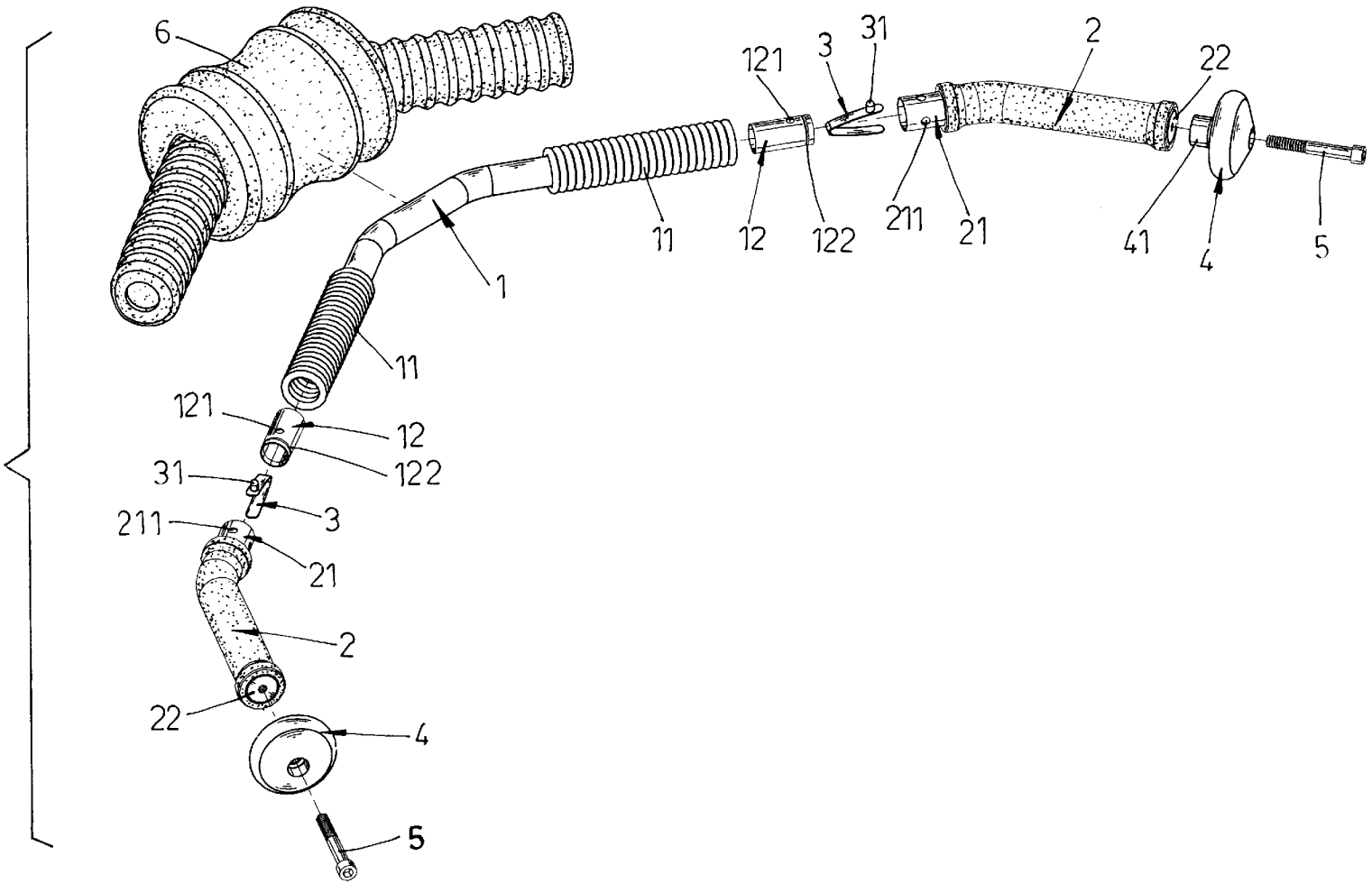
FIG. 2 is a disassembly of a body builder of the invention.
Figure 3:
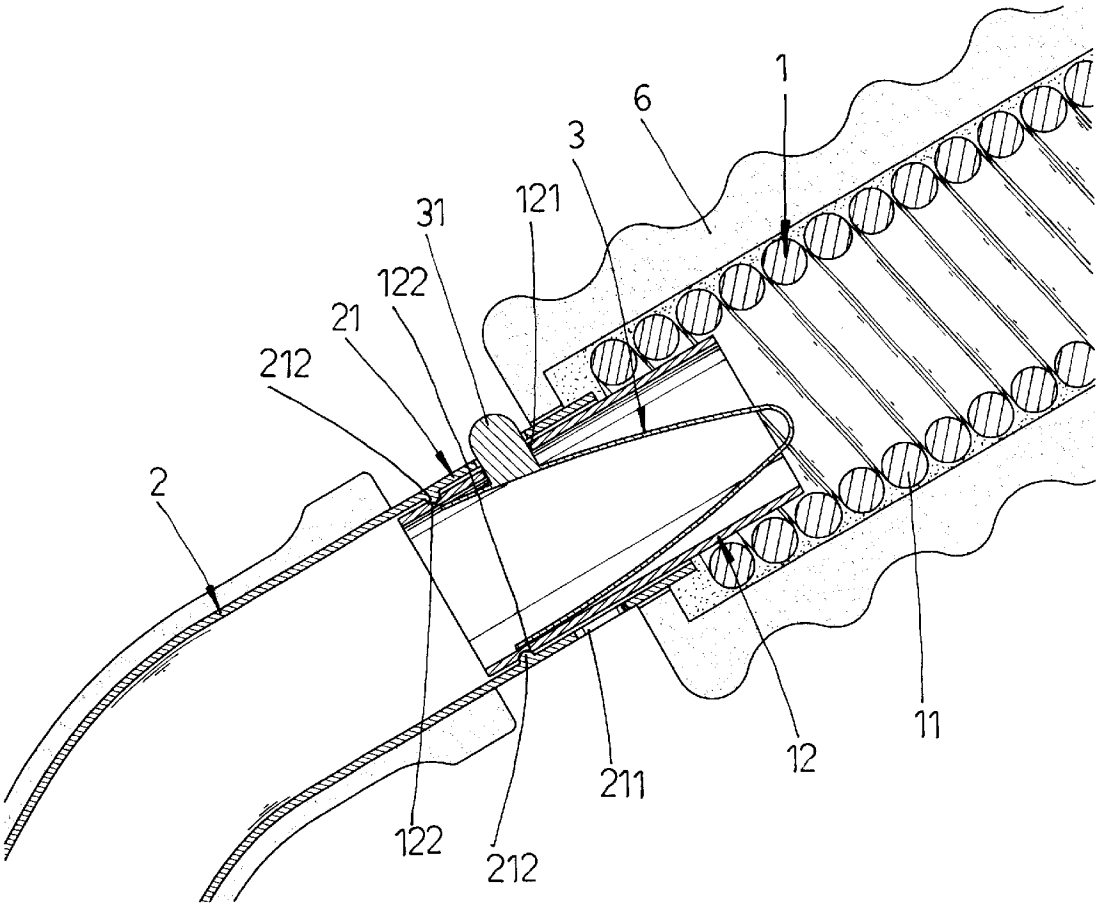
FIG. 3 is a cross-section of a body builder of the invention.
Figure 4:
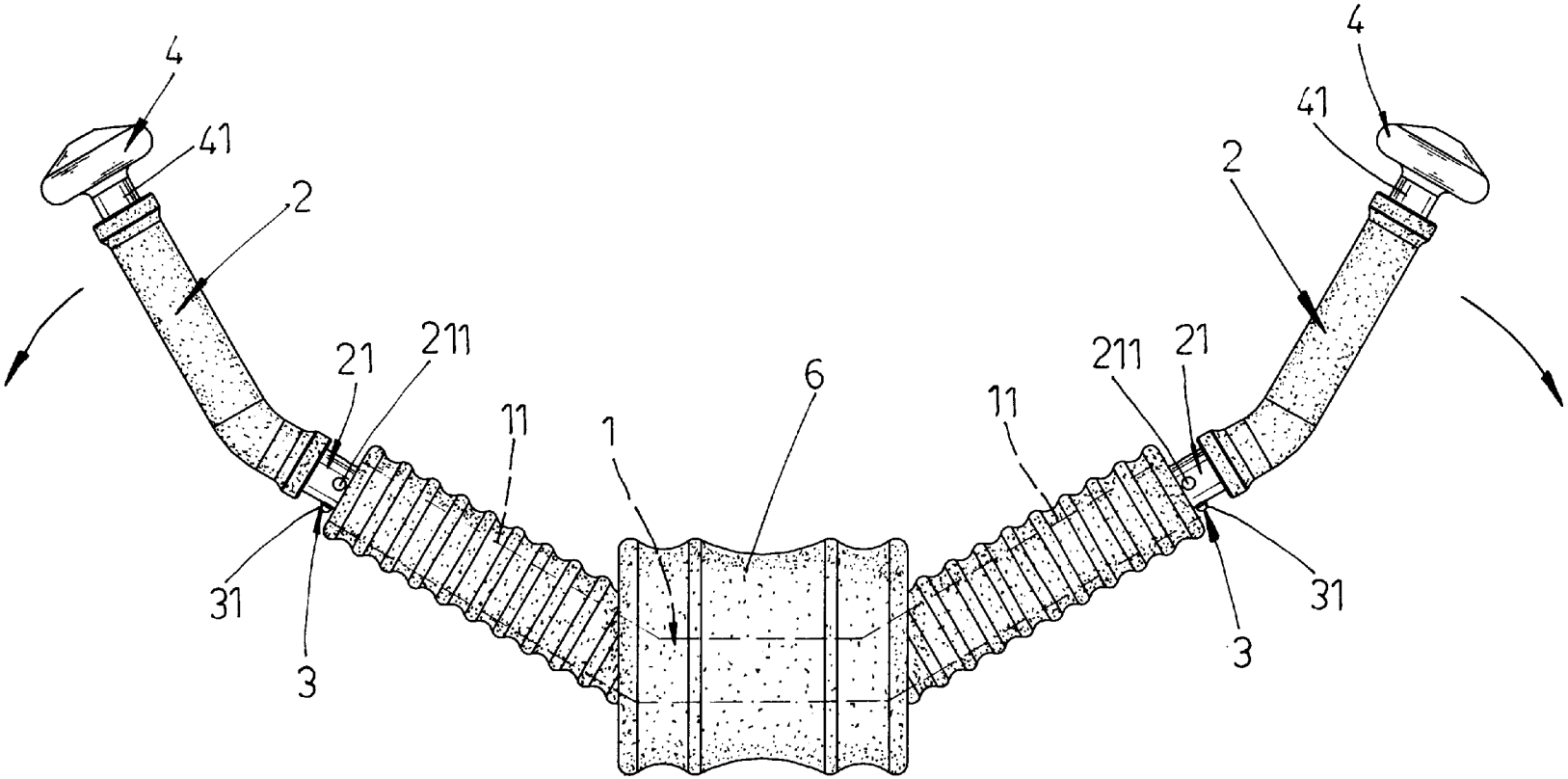
FIG. 4 shows a changed angle of a body builder of the invention (1).
Figure 5:
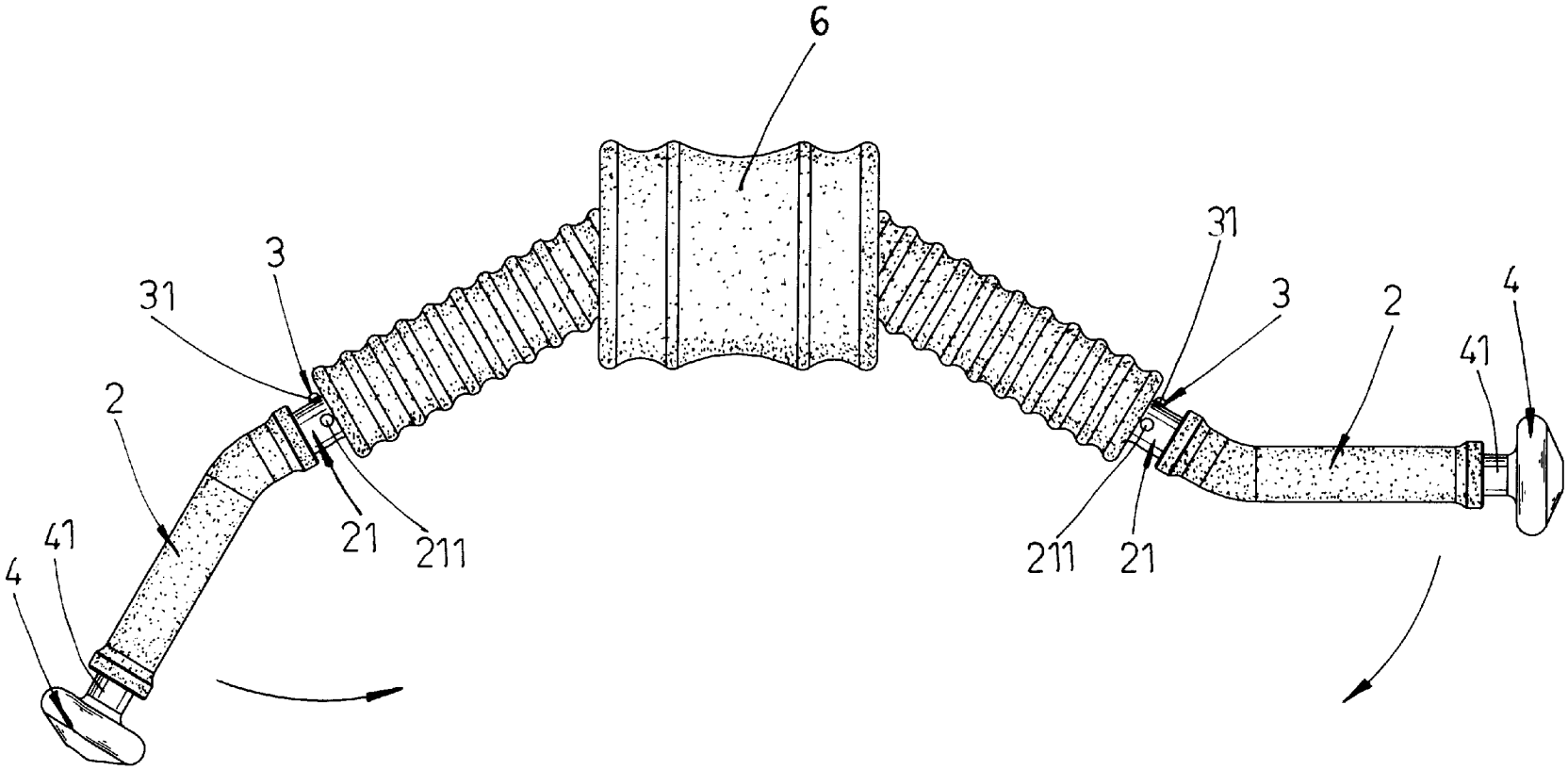
FIG. 5 shows a changed angle of a body builder of the invention (2).
Figure 6:
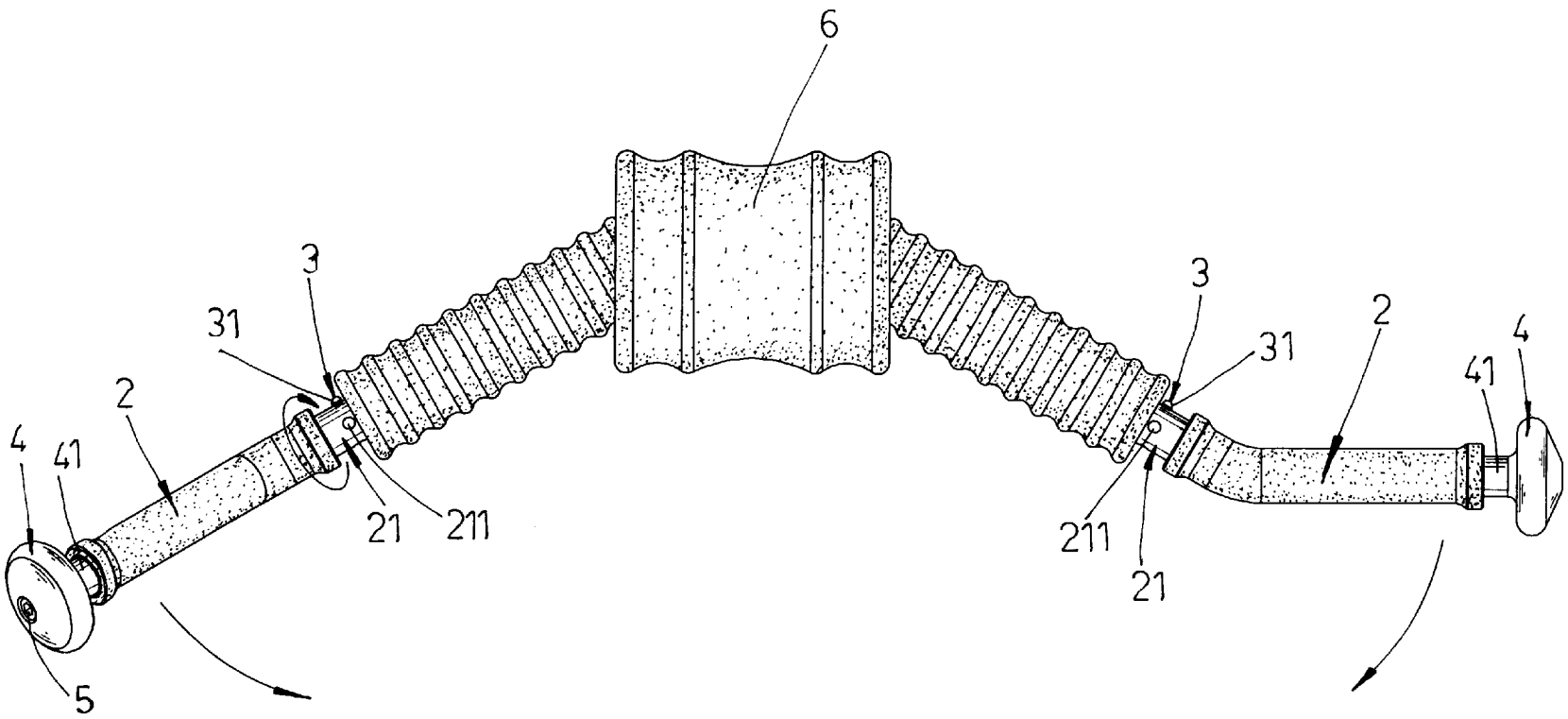
FIG. 6 shows a changed angle of a body builder of the invention (3).
Figure 7:
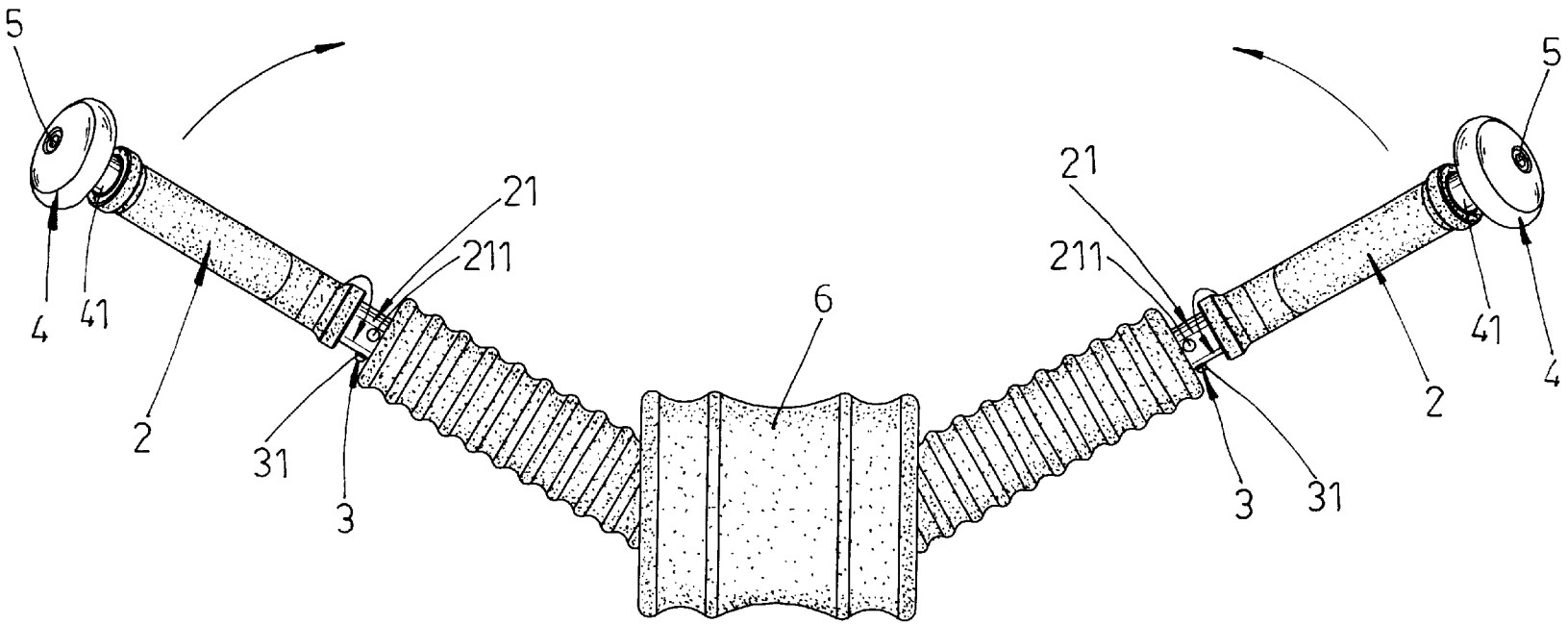
FIG. 7 shows a changed angle of a body builder of the invention (4).
Figure 8:
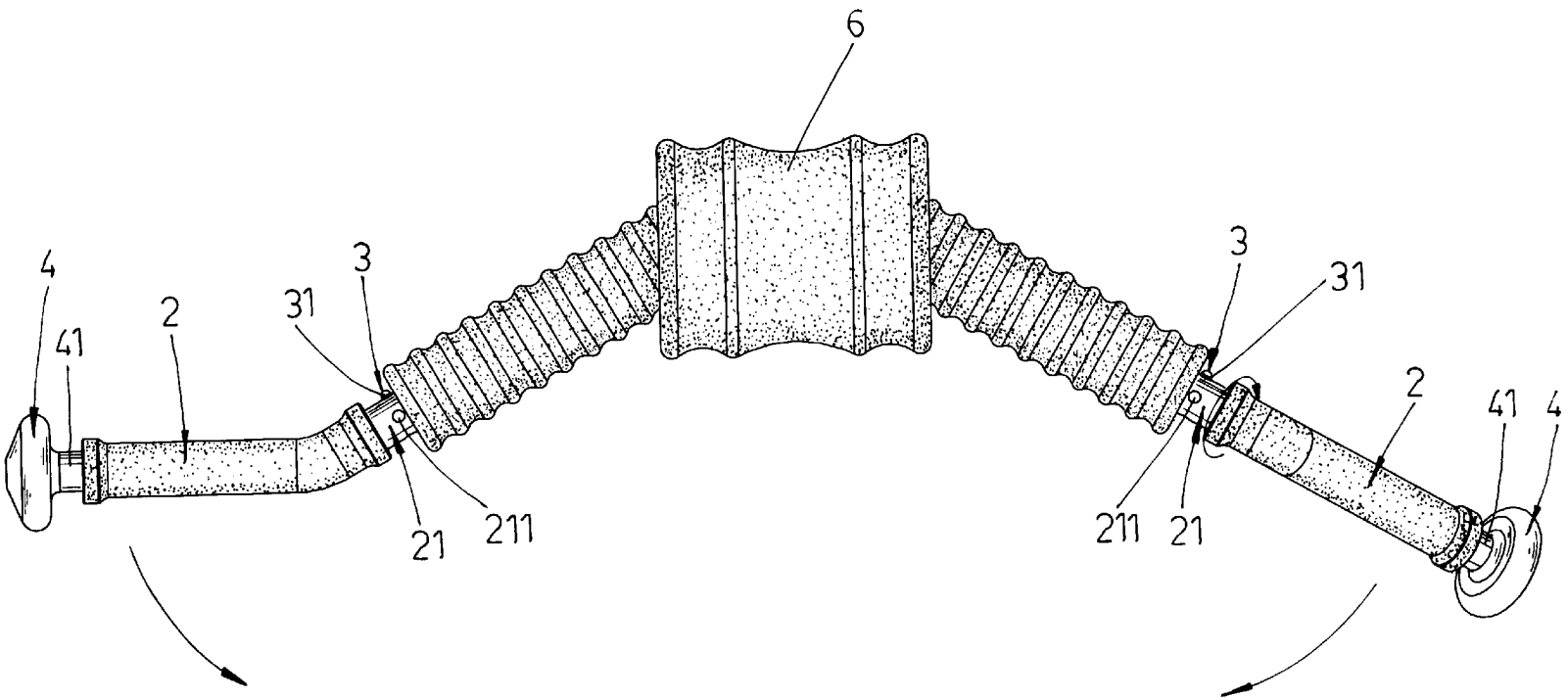
FIG. 8 shows a changed angle of a body builder of the invention (5).

As shown in FIGS. 1 through 3, the multi-directional swivel body builder of the invention mainly comprises a moveable bent shank 1, two handles 2, two retaining springs 3, two end wheels 4 and a protection jacket 6, where the moveable bent shank 1 is bent inward and links to a coil spring 11. The other end of the coil spring 11 hooks with two joint tube 12. The bent shank 1 and the coil spring 11 are wrapped in a protection jacket 6 so to prevent the coil spring 11 from causing personnel injury during the playing. The joint tube 12 has the lock hole 121 and a ring groove 122 at the far end, while the retaining spring 3 can be fixed inside the joint tube 12.

The retaining spring 3 has a turnover leave and a lock post 31 which will fit in the lock hole 121 of the joint tube 12. The joint tube 12 is to slide into the sleeve tube 21 of the handle 2. The sleeve tube 21 provides a plurality of adjustable holes 211. After the joint tube 12 slides in place in the sleeve tube 21, the lock post 31 will fit into one hole of the adjustable holes 211 on the sleeve tube 21. In the meantime, the catch lug 212 on the inner wall of the sleeve tube 21 will slip into the ring groove 122 of the joint tube 12 in order to press the lock post 31 of the retaining spring 3, allowing the catch lug 212 to move in the ring groove 122. After the handles 2 have gained the proper angle, the lock post 31 will enter into the adjustable hole 211 to hold the handle 2 steadfast there.

The rear end 22 of the handle 2 connects to a lock shaft 5, an end wheel 4 and a spacer 41. The spacer 41 is employed to keep adequate distance from the handle 2 for easy hand operation.

As shown in FIGS. 4 through 8, the handles 2 can be operated in multi-directions. Each angular direction can bring an effective effort on hand, chest, arm muscle or abdomen. The handles 2 can be operated in a bending form or in a straight form. The bending form requires less power, while the straight form consumes much more energy. The multi-directional change provokes significant challenges, adjustable in accordance with personal habit.

Figure 9:
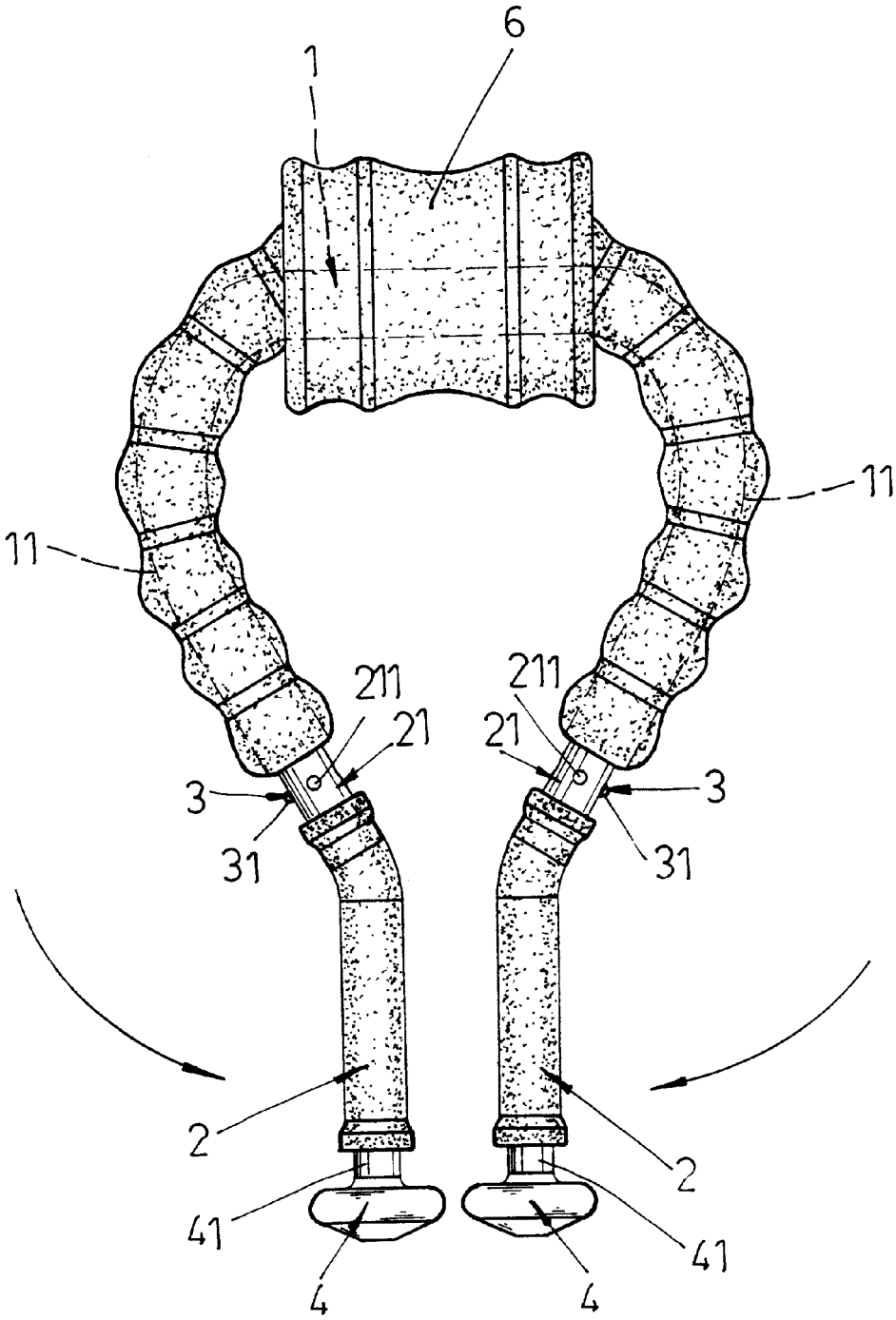
FIG. 9 shows a round bending of a body builder of the invention.

As shown in FIG. 9, the coil spring 11 of the moveable bent shank is bent into a full round curve, feasible to be placed on the neck or the waist without causing any injury.

Figure 10:
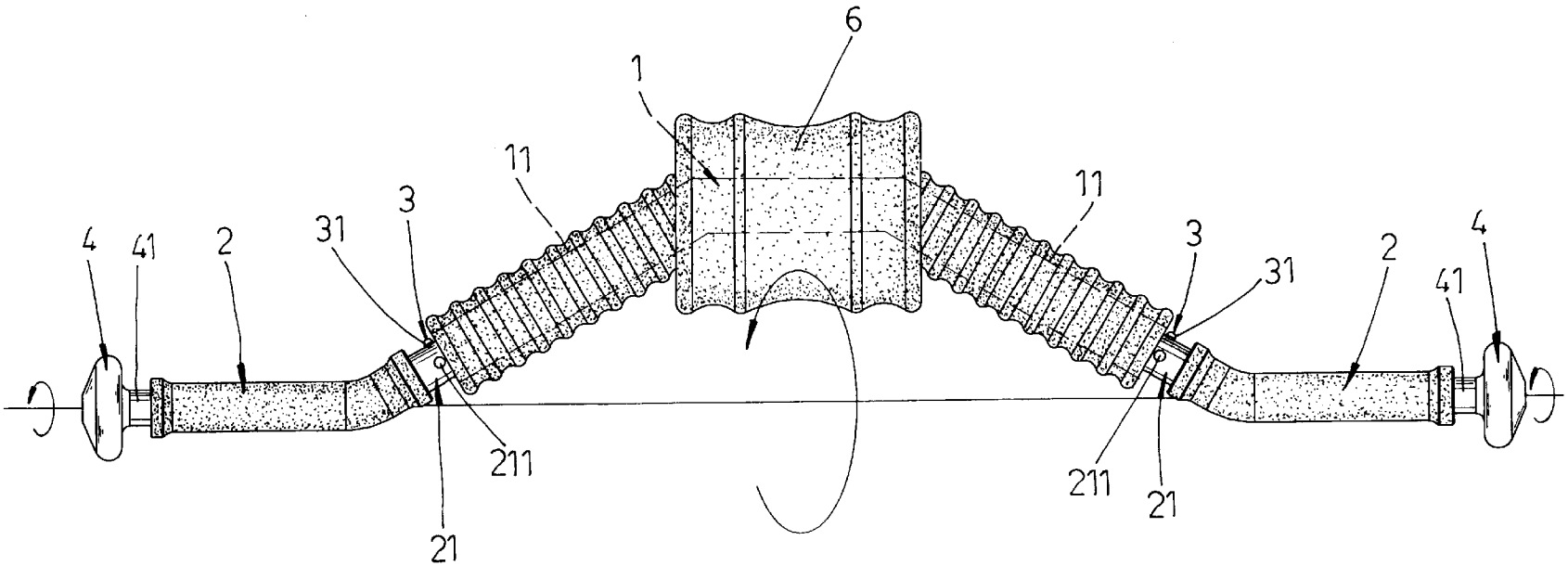
FIG. 10 shows that the bent shank is rotating.

As shown in FIG. 10, when the handles 2 are bent in a relative angle, the end wheels 4 can be bent and swayed. With the axial connection between the lock shaft 5 and the end wheel 4, when the hands swing, the handles 2 will rotate together with the moveable bent shank 1. Due to the eccentric design of the moveable bent shank 1, it continues to self-rotation by the centrifugal and inertia force.

Viewing from the above statement, it is learned that the multi-directional swivel body builder provides better performance, much better than the hand grips. It is an aggressive improvement, justified for a favorable grant of new patent.

What is claimed is:

1. A multi-directional swivel body builder, mainly comprising a moveable bent shank, two handles, two retaining springs and two end wheels, each end of said bent shank linking with a coil spring, a protection jacket covering said bent shank and said coil springs, characterized in that:

a joint tube has a lock hole and a ring groove for receiving said retaining spring, said retaining spring has a turn-over leave with a lock post fitting into said lock hole of said joint tube, said joint tube slides into a sleeve tube of said handle, said sleeve tube has a plurality of adjustable holes, after said joint tube slides in place in said sleeve tube, said lock post of said retaining spring will fit into one of said adjustable holes and a catch lug on an inner wall of said sleeve tube will enter said ring groove of said joint tube to disengage said lock post of said retaining spring, permitting said handle to adjust and gain a proper bent angle, then said lock post fits into said proper adjustable hole and holds said angle said handles accomplished said adjustment; and said handle end connects to a lock shaft and an end wheel, when said end wheel is swayed, said bent shank begins self-rotation.

* * * * *